US007828423B2

(12) United States Patent
Larson et al.

(10) Patent No.: US 7,828,423 B2
(45) Date of Patent: Nov. 9, 2010

(54) INK-JET PRINTER USING PHASE-CHANGE INK PRINTING ON A CONTINUOUS WEB

(75) Inventors: James R Larson, Fairport, NY (US); Jeffrey J Folkins, Rochester, NY (US); Roger A Newell, Pittsford, NY (US); Donald M Bott, Rochester, NY (US); Roger Leighton, Rochester, NY (US); Edward B Caruthers, Jr., Rochester, NY (US); David J Gervasi, Pittsford, NY (US); David A Mantell, Rochester, NY (US); Vincent M Williams, Palmyra, NY (US); Michael J Levy, Webster, NY (US); James M Casella, Webster, NY (US); Jeremy C Dejong, Orchard Park, NY (US); Paul J Mcconville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 755 days.

(21) Appl. No.: 11/773,549

(22) Filed: Jul. 5, 2007

(65) Prior Publication Data

US 2009/0009573 A1 Jan. 8, 2009

(51) Int. Cl.
*B41J 2/175* (2006.01)

(52) U.S. Cl. ..... 347/88

(58) Field of Classification Search ..... 347/85, 347/88, 102, 103, 99

See application file for complete search history.

(56) References Cited

U.S. PATENT DOCUMENTS

| | | | | |
|---|---|---|---|---|
| 5,345,863 | A | 9/1994 | Kurata et al. | |
| 5,389,958 | A | 2/1995 | Bui et al. | |
| 5,406,315 | A | 4/1995 | Allen et al. | |
| 5,502,476 | A * | 3/1996 | Neal et al. | 347/103 |
| 5,774,155 | A | 6/1998 | Medin et al. | |
| 5,777,650 | A | 7/1998 | Blank | |
| 5,793,398 | A | 8/1998 | Hennig | |
| 6,113,231 | A | 9/2000 | Burr et al. | |
| 6,161,930 | A | 12/2000 | Asano | |
| 6,196,675 | B1 | 3/2001 | Deily et al. | |
| 6,361,230 | B1 | 3/2002 | Crystal et al. | |
| 6,485,140 | B1 | 11/2002 | Lidke et al. | |
| 6,494,570 | B1 | 12/2002 | Snyder | |

FOREIGN PATENT DOCUMENTS

| | | |
|---|---|---|
| EP | 0938974 | 9/1999 |
| EP | 1533129 | 5/2005 |
| JP | 02026747 | 1/1990 |

OTHER PUBLICATIONS

European Search Report, European Patent Office, Munich, Germany, Oct. 6, 2008.

* cited by examiner

*Primary Examiner*—An H Do
(74) *Attorney, Agent, or Firm*—Maginot, Moore & Beck LLP

(57) ABSTRACT

A printing apparatus includes a printing station, including at least one printhead for applying phase-change ink to the substrate, and a backing member disposed on an opposite side of the substrate substantially opposite the printhead, the backing member causing the substrate to reach a predetermined ink-receiving temperature.

27 Claims, 1 Drawing Sheet

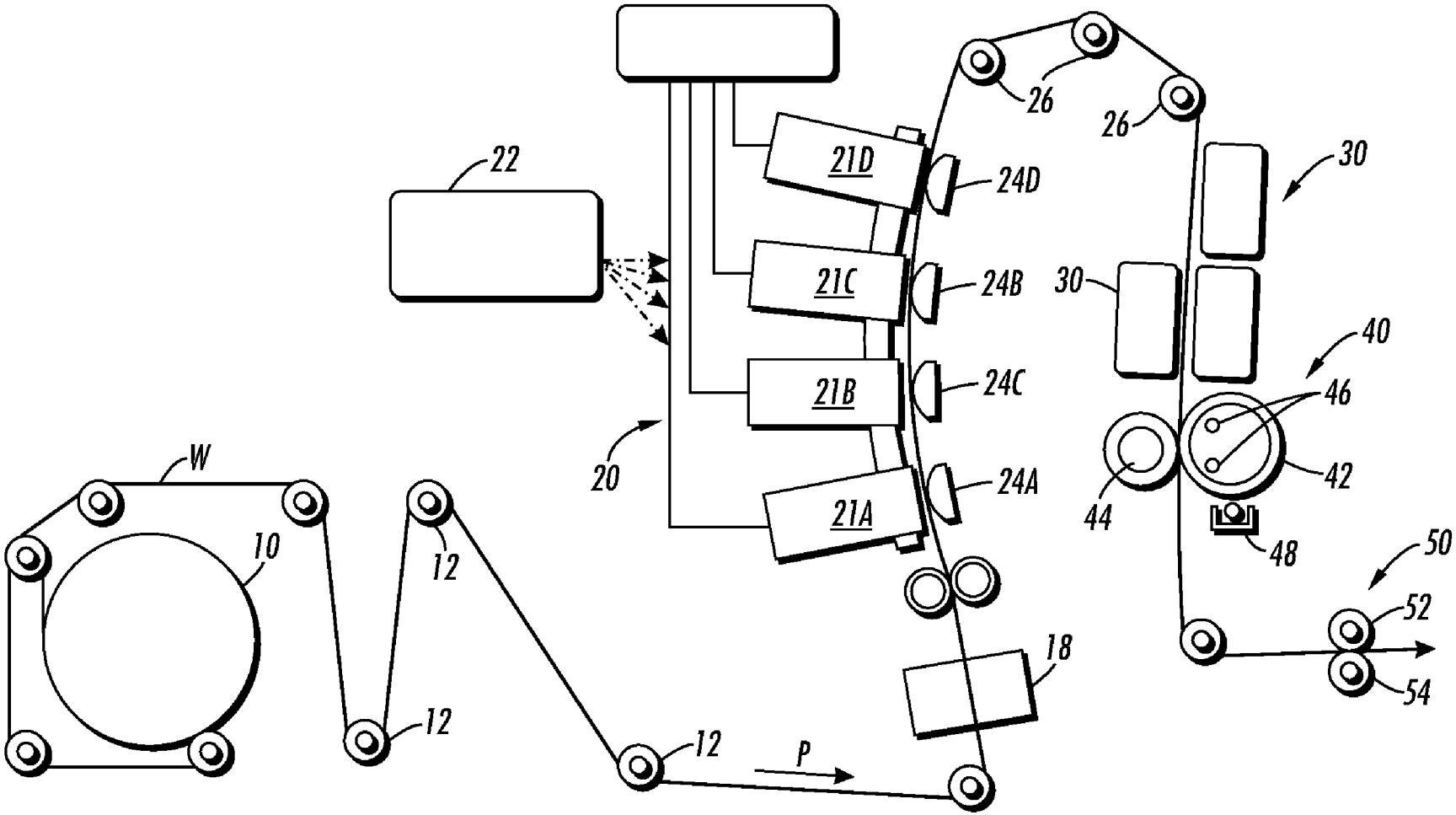
30
40
46
42
48
50
52
54
26
26
30
44
24D
24B
24C
24A
18
21D
21C
21B
21A
P
12
20
22
12
12
10
W

INK-JET PRINTER USING PHASE-CHANGE INK PRINTING ON A CONTINUOUS WEB

TECHNICAL FIELD

The present disclosure relates to ink-jet printing, particularly involving phase-change inks printing on a substantially continuous web.

BACKGROUND

Ink jet printing involves ejecting ink droplets from orifices in a print head onto a receiving surface to form an image. The image is made up of a grid-like pattern of potential drop locations, commonly referred to as pixels. The resolution of the image is expressed by the number of ink drops or dots per inch (dpi), with common resolutions being 300 dpi and 600 dpi.

Ink-jet printing systems commonly utilize either a direct printing or offset printing architecture. In a typical direct printing system, ink is ejected from jets in the print head directly onto the final receiving web. In an offset printing system, the image is formed on an intermediate transfer surface and subsequently transferred to the final receiving web. The intermediate transfer surface may take the form of a liquid layer that is applied to a support surface, such as a drum. The print head jets the ink onto the intermediate transfer surface to form an ink image thereon. Once the ink image has been fully deposited, the final receiving web is then brought into contact with the intermediate transfer surface and the ink image is transferred to the final receiving web.

U.S. Pat. No. 5,389,958, assigned to the assignee of the present application, is an example of an indirect or offset printing architecture that utilizes phase change ink. The ink is applied to an intermediate transfer surface in molten form, having been melted from its solid form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving web, such as a sheet of media, is then fed into the transfer nip and the ink image is transferred to the final receiving web.

U.S. Pat. Nos. 5,777,650; 6,494,570; and 6,113,231 show the application of pressure to ink-jet-printed images. U.S. Pat. Nos. 5,345,863; 5,406,315; 5,793,398; 6,361,230; and 6,485,140 describe continuous-web ink-jet printing systems.

SUMMARY

According to one aspect, a printing apparatus includes a printing station, including at least one printhead for applying phase-change ink to the substrate, and a backing member disposed on an opposite side of the substrate substantially opposite the printhead, the backing member causing the substrate to reach a predetermined ink-receiving temperature.

According to another aspect, there is provided a printing apparatus, comprising means for moving a substrate through a path; a preheater for bringing the substrate to a predetermined preheat temperature; and a printing station, disposed downstream of the preheater along the path. The printing station includes at least one printhead for applying phase-change ink to the substrate, and means for maintaining the temperature of the substrate within a predetermined ink-receiving temperature range.

According to another aspect, there is provided a printing apparatus, comprising means for moving a substrate through a path; a printing station, including at least one printhead for applying phase-change ink to the substrate; a midheater disposed along the path downstream of the printing station; and a spreader disposed along the path downstream of midheater, for subjecting the substrate to a pressures not less than 500 psi.

BRIEF DESCRIPTION OF THE DRAWING

The FIGURE is a simplified elevational view of a direct-to-sheet, continuous-web, phase-change ink printer.

DETAILED DESCRIPTION

The FIGURE is a simplified elevational view of a direct-to-sheet, continuous-web, phase-change ink printer. A very long (i.e., substantially continuous) web W of "substrate" (paper, plastic, or other printable material), supplied on a spool 10, is unwound as needed, propelled by a variety of motors, not shown. A set of rolls 12 controls the tension of the unwinding web as the web moves through a path.

Along the path there is provided a preheater 18, which brings the web to an initial predetermined temperature. The preheater 18 can rely on contact, radiant, conductive, or convective heat to bring the web W to a target preheat temperature, in one practical embodiment, of about 30° C. to about 70° C.

The web W moves through a printing station 20 including a series of printheads 21A, 21B, 21C, and 21D, each printhead effectively extending across the width of the web and being able to place ink of one primary color directly (i.e., without use of an intermediate or offset member) onto the moving web. As is generally familiar, each of the four primary-color images placed on overlapping areas on the web W combine to form a full-color image, based on the image data sent to each printhead through image path 22. In various possible embodiments, there may be provided multiple printheads for each primary color; the printheads can each be formed into a single linear array; the function of each color printhead can be divided among multiple distinct printheads located at different locations along the process direction; or the printheads or portions thereof can be mounted movably in a direction transverse to the process direction P, such as for spot-color applications.

The ink directed to web W in this embodiment is a "phase-change ink," by which is meant that the ink is substantially solid at room temperature and substantially liquid when initially jetted onto the web W. Currently-common phase-change inks are typically heated to about 100° C. to 140° C., and thus in liquid phase, upon being jetted onto the web W. Generally speaking, the liquid ink cools down quickly upon hitting the web W.

Associated with each primary color printhead is a backing member 24A, 24B, 24C, 24D, typically in the form of a bar or roll, which is arranged substantially opposite the printhead on the other side of web W. Each backing member is used to position the web W so that the gap between the printhead and the sheet stays at a known, constant distance. Each backing member can be controlled to cause the adjacent portion of the web to reach a predetermined "ink-receiving" temperature, in one practical embodiment, of about 40° C. to about 60° C. In various possible embodiments, each backing member can include heating elements, cavities for the flow of liquids therethrough, etc.; alternatively, the "member" can be in the form of a flow of air or other gas against or near a portion of the web W. The combined actions of preheater 18 plus backing members 24 held to a particular target temperature effectively maintains the web W in the printing zone 20 in a predetermined temperature range of about 45° C. to 65° C.

As the partially-imaged web moves to receive inks of various colors throughout the printing station 20 it is required that the temperature of the web be maintained to within a given range. Ink is jetted at a temperature typically significantly higher than the receiving web's temperature and thus will heat the surrounding paper (or whatever substance the web W is made of). Therefore the members in contact with or near the web in zone 20 must be adjusted so that that the desired web temperature is maintained. For example, although the backing members will have an effect on the web temperature, the air temperature and air flow rate behind and in front of the web will also impact the web temperature and thus must be considered when controlling the web temperature, and thus the web temperature could be affected by utilizing air blowers or fans behind the web in printing station 20.

Thus, the web temperature is kept substantially uniform for the jetting of all inks from printheads in the printing zone 20. This uniformity is valuable for maintaining image quality, and particularly valuable for maintaining constant ink lateral spread (i.e., across the width of web W, such as perpendicular to process direction P) and constant ink penetration of the web. Depending on the thermal properties of the particular inks and the web, this web temperature uniformity may be achieved by preheating the web and using uncontrolled backer members, and/or by controlling the different backer members 24A, 24B, 24C, 24D to different temperatures to keep the substrate temperature substantially constant throughout the printing station. Temperature sensors (not shown) associated with the web W may be used with a control system to achieve this purpose, as well as systems for measuring or inferring (from the image data, for example) how much ink of a given primary color from a printhead is being applied to the web W at a given time. The various backer members can be controlled individually, using input data from the printhead adjacent thereto, as well as from other printheads in the printing station.

Following the printing zone 20 along the web path is a series of tension rolls 26, followed by one or more "midheaters" 30. The midheater 30 can use contact, radiant, conductive, and/or convective heat to bring the web W to the target temperature. The midheater 30 brings the ink placed on the web to a temperature suitable for desired properties when the ink on the web is sent through the spreader 40. In one embodiment, a useful range for a target temperature for the midheater is about 35° C. to about 80° C. The midheater 30 has the effect of equalizing the ink and substrate temperatures to within about 15° C. of each other. Lower ink temperature gives less line spread while higher ink temperature causes show-through (visibility of the image from the other side of the print). The midheater 30 adjusts substrate and ink temperatures to 0° C. to 20° C. above the temperature of the spreader, which will be described below.

Following the midheaters 30, along the path of web W, is a "spreader" 40, that applies a predetermined pressure, and in some implementations, heat, to the web W. The function of the spreader 40 is to take what are essentially isolated droplets of ink on web W and smear them out to make a continuous layer by pressure, and, in one embodiment, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rolls, such as image-side roll 42 and pressure roll 44, that apply heat and pressure to the web W. Either roll can include heat elements such as 46 to bring the web W to a temperature in a range from about 35° C. to about 80° C.

In one practical embodiment, the roll temperature in spreader 40 is maintained at about 55° C.; generally, a lower roll temperature gives less line spread while a higher temperature causes imperfections in the gloss. A roll temperature higher than about 57° C. causes ink to offset to the roll. In one practical embodiment, the nip pressure is set in a range of about 500 to about 2000 psi lbs/side. Lower nip pressure gives less line spread while higher may reduce pressure roll life.

The spreader 40 can also include a cleaning/oiling station 48 associated with image-side roll 42, suitable for cleaning and/or applying a layer of some lubricant or other material to the roll surface. Such a station coats the surface of the spreader roll with a lubricant such as amino silicone oil having viscosity of about 10-200 centipoises. Only small amounts of oil are required and the oil carry out by web W is only about 1-10 mg per A4 size page.

In one possible embodiment, the midheater 30 and spreader 40 can be combined within a single unit, with their respective functions occurring relative to the same portion of web W simultaneously.

Following the spreader 40, the printer in this embodiment includes a "glosser" 50, whose function is to change the gloss of the image (such a glosser can be considered an "option" in a practical implementation). The glosser 50 applies a predetermined combination of temperature and pressure, to obtain a desired amount of gloss on the ink that has just been spread by spreader 40. Additionally, the glosser roll surface may have a texture that the user desires to impress on the ink surface. The glosser 50 includes two rolls (image-side roll 52 and pressure roll 54) forming a nip through which the web W passes. In one practical embodiment, the controlled temperature at spreader 40 is about 35° C. to about 80° C. and the controlled temperature at glosser 50 is about 30° C. to about 70° C.

In each of the spreader 40 and glosser 50, the image side roll 42 or 52 contacting the inked side of the web is typically reasonably hard, such as being made of anodized aluminum. In each case, for the pressure roll 44 or 54, a relatively softer roll is used, with a durometer anywhere from about 50 D to about 65 D, with elastic modulii from about 65 MPa to about 115 MPa, and may include a thin elastomer overcoat. In various practical applications, elastomeric or rubbery pressure rolls of one or more layers, with effective elastic modulii from about 50 MPa to about 200 MPa, can be provided.

In a practical implementation, detailed and independent control of the respective temperatures associated with spreader 40 and glosser 50 (by a control system, not shown) enables gloss adjustment given particular operating conditions and desired print attributes.

Typical pressure against the web W for the roll pairs in each of the spreader 40 and glosser 50 is about 500 to about 2000 lbs/square inch. Adjustment of the pressure is advisable with ink formulations that are soft enough that high pressure would cause excessive spreading. It is also possible to provide an image-side roll 52 in glosser 50 with different surface textures so that, with higher temperature and pressure, texture can be impressed into the ink surface.

It will be recognized by those experienced in the art that the temperatures and pressures effective for spreading an ink of a given formulation will depend on the ink's specific thermal properties. If solvent- or water-based inks were used (i.e., not phase-change ink) in the given implementation, the ink would not necessarily land on the media as a drop but will generally spread out on its own and thus form a smooth layer, rendering, for example, the effect of the spreader 40 and other elements uncertain. Similarly, teachings involving placement of dye or inks on a substantially porous substrate such as woven or knit fabric are not necessarily applicable to the present disclosure, as, for instance, the use of a spreader such as 40 on cloth is likely to cause ink to be pushed through the cloth. For this and other reasons, many teachings relating to the application of solvent- or water-based inks to webs of various types are not applicable to the present discussion.

Following passage through the spreader 40 and glosser 50, the printed web can be imaged on the other side, and then cut into pages, such as for binding (not shown). Although printing on a substantially continuous web is shown in the embodiment, the claimed invention can be applied to a cut-sheet system as well. Different preheat, midheat and spreader temperature setpoints can be selected for different types and weights of web media.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printing apparatus, comprising:

means for moving a substrate through a path;

a printing station, disposed along the path, the printing station including at least a first printhead and a second printhead for applying phase-change ink to the substrate moving along the path, the first printhead having a first backing member disposed on the path at a position opposite the first printhead and the second printhead having a second backing member disposed on the path at a position opposite the second printhead, the first and second backing members causing a substrate passing between the backing members and the printheads to reach a temperature in a predetermined ink-receiving temperature range, the ink-receiving temperatures for the first backing member and for the second backing member being independently controllable to obtain a substantially constant substrate temperature through a printing zone.

2. The apparatus of claim 1, the first and second backing members bringing the substrate to an ink-receiving temperature in a range of about 40° C. to about 60° C., where the phase-change ink is at a temperature of about 100° C. to about 140° C., upon being applied to the substrate.

3. The apparatus of claim 1, wherein the substrate is a substantially continuous web.

4. The apparatus of claim 1, wherein the substrate substantially comprises paper.

5. The apparatus of claim 1, further comprising a preheater, disposed upstream of the printing station along the path, for bringing the substrate to a predetermined preheat temperature.

6. The apparatus of claim 5, the preheater bringing the substrate to a preheat temperature in a range of about 30° C. to about 70° C.

7. The apparatus of claim 1 further comprising:

a midheater disposed downstream of the printing station along the path, the midheater having an effect of equalizing the ink and substrate temperatures to within about 15° C. of each other.

8. The apparatus of claim 1 further comprising:

a midheater disposed downstream of the printing station along the path, the midheater bringing the substrate to a temperature in a range of about 35° C. to about 80° C.

9. The apparatus of claim 8, further comprising a spreader disposed downstream of the midheater along the path, the spreader applying pressure to the substrate.

10. The apparatus of claim 9, the spreader bringing the substrate to a temperature in a range from about 35° C. to about 80° C.

11. The apparatus of claim 9, the midheater causing the substrate and ink temperatures to be 0° C. to 20° C. above the temperature of the spreader.

12. The apparatus of claim 9, further comprising a glosser disposed downstream of the spreader along the path, the glosser applying pressure to the substrate.

13. The apparatus of claim 12, a temperature associated with the spreader being about 35° C. to about 80° C. and a temperature associated with the glosser being about 30° C. to about 70° C.

14. The apparatus of claim 1 wherein an input to controlling the ink-receiving temperatures of at least one of the first backing member and the second backing member relates to a measured temperature associated with the substrate.

15. The apparatus of claim 1 wherein an input to controlling the ink-receiving temperatures of at least one of the first backing member and the second backing member relates to an amount of ink applied to the substrate by a printhead at a given time.

16. The apparatus of claim 1, wherein the first backing member and the second backing member each include a roll.

17. The apparatus of claim 1, wherein the first backing member and the second backing member each include a flow of gas against the substrate.

18. A printing apparatus, comprising:

means for moving a substrate through a path;

a preheater for bringing the substrate to a predetermined preheat temperature;

a printing station, disposed downstream of the preheater along the path, the printing station including at least a first printhead and a second printhead for applying phase-change ink to the substrate moving along the path, the first printhead having a first backing member disposed on the path at a position opposite the first printhead and the second printhead having a second backing member disposed on the path at a position opposite the second printhead, the first and second backing members causing a substrate passing between the backing members and the printheads to reach a temperature in a predetermined ink-receiving temperature range, the ink-receiving temperatures for the first backing member and for the second backing member being independently controllable to obtain a substantially constant substrate temperature through a printing zone.

19. The apparatus of claim 18, the preheater bringing the substrate to a preheat temperature in a range of about 30° C. to about 70° C.

20. The apparatus of claim 18, the first and the second backing members bringing the substrate to an ink-receiving temperature in a range of about 40° C. to about 60° C., where the phase-change ink is at a temperature of about 100° C. to about 140° C., upon being applied to the substrate.

21. A printing apparatus, comprising:

means for moving a substrate through a path;

a printing station, disposed along the path, the printing station including at least a first printhead and a second printhead for applying phase-change ink to the substrate moving along the path, the first printhead having a first backing member disposed on the path at a position opposite the first printhead and the second printhead having a second backing member disposed on the path at a position opposite the second printhead, the first and second backing members causing a substrate passing between the backing members and the printheads to reach a temperature in a predetermined ink-receiving temperature range, the ink-receiving temperatures for the first backing member and for the second backing member being independently controllable to obtain a substantially constant substrate temperature through a printing zone;

a midheater disposed along the path downstream of the printing station; and a spreader disposed along the path downstream of midheater, for subjecting the substrate to a pressures not less than 500 psi.

22. The apparatus of claim 21, the midheater having an effect of equalizing the ink and substrate temperatures to within about 15° C. of each other.

23. The apparatus of claim 21, the midheater bringing the substrate to a temperature in a range of about 35° C. to about 80° C.

24. The apparatus of claim 21, the spreader bringing the substrate to a temperature in a range from about 35° C. to about 80° C.

25. The apparatus of claim 21, the midheater causing the substrate and ink temperatures to be 0° C. to 20° C. above the temperature of the spreader.

26. The apparatus of claim 21 further comprising:

a glosser disposed downstream of the spreader along the path, the glosser applying pressure to the substrate.

27. The apparatus of claim 26, a temperature associated with the spreader being about 35° C. to about 80° C. and a temperature associated with the glosser being about 30° C. to about 70° C.

* * * * *